US005123697A

United States Patent [19]

Szczurek

[11] Patent Number: 5,123,697

[45] Date of Patent: Jun. 23, 1992

[54] MULTIPOSITION CHAIR

[76] Inventor: Zenon M. Szczurek, Bohlstrasse 34, D-7401 Nehren, Fed. Rep. of Germany

[21] Appl. No.: 714,162

[22] Filed: Jun. 12, 1991

[30] Foreign Application Priority Data

Jun. 12, 1990 [DE] Fed. Rep. of Germany ..... 4018724

[51] Int. Cl.[5] ..... A47C 4/12

[52] U.S. Cl. ..... 297/23; 297/126; 297/377; 297/423

[58] Field of Search ..... 297/21-23, 297/118, 126, 377, 423

[56] References Cited

U.S. PATENT DOCUMENTS

| | | | |
|---|---|---|---|
| 780,311 | 1/1905 | Steinbach | 297/126 X |
| 2,627,899 | 2/1953 | Grotefend | 297/23 |
| 3,083,999 | 4/1963 | Silva . | |
| 4,614,378 | 9/1986 | Picou | 297/92 |

FOREIGN PATENT DOCUMENTS

| | | | |
|---|---|---|---|
| 40368 | 6/1929 | Denmark | 297/23 |
| WO89/06506 | 7/1989 | European Pat. Off. . | |
| 2558639 | 7/1977 | Fed. Rep. of Germany . | |
| 793536 | 1/1936 | France | 297/126 |
| 443271 | 12/1948 | Italy | 297/23 |

*Primary Examiner*—Peter R. Brown

*Attorney, Agent, or Firm*—Herbert Dubno; Andrew Wilford

[57] ABSTRACT

A multiple-position chair has a main frame, a lower frame, and an intermediate frame. The main frame has a pair of parallel longitudinal side bars having lower ends normally engaging the ground and upper ends and a transverse bar interconnecting the lower ends. The lower frame has a pair of parallel side bars having upper ends pivoted about a lower transverse axis on the main frame intermediate the main-frame ends and lower ends normally engaging the ground. The lower-frame side bars each are formed intermediate their ends with a row of upwardly open seats. Another transverse bar interconnects the lower ends of the lower-frame side bars. The intermediate frame has a pair of parallel side bars having upper ends pivoted on the main-frame side bars about an intermediate transverse axis at the main-frame upper ends and lower ends and a transverse bar interconnecting the lower ends of the intermediate-frame side bars and fittable in the seats of the lower frame side bars. All the transverse bars are generally parallel. A flat main support is generally centrally pivoted on the frames about the lower transverse axis at the upper ends of the lower frame and an intermediate flat support is generally centrally pivoted on the frames about the intermediate transverse axis at the upper ends of the main frame.

12 Claims, 5 Drawing Sheets

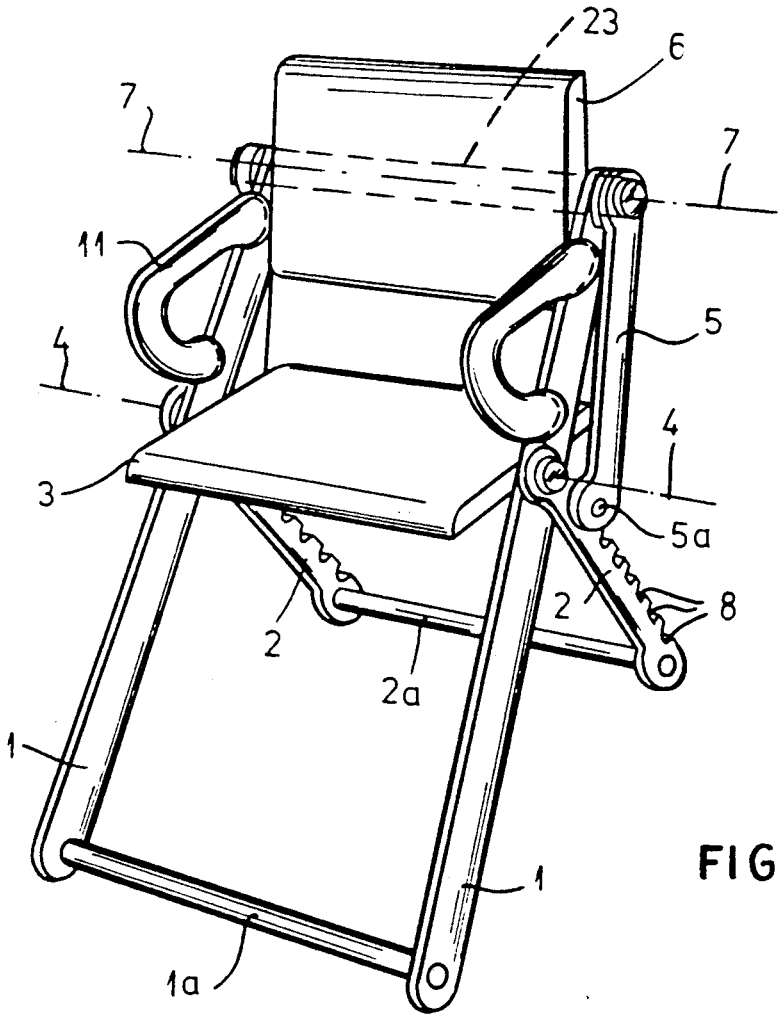
FIG.1
FIG.2
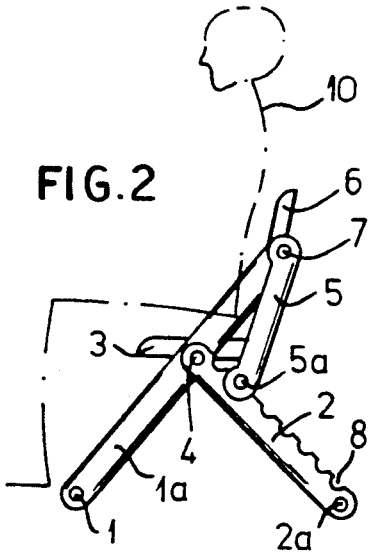
FIG.3
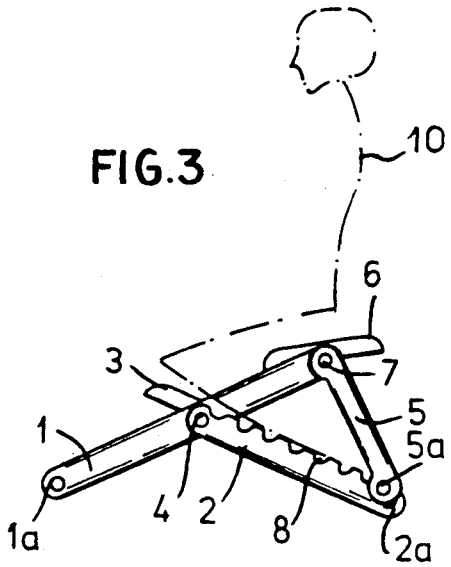

MULTIPOSITION CHAIR

FIELD OF THE INVENTION

The present invention relates to a chair. More particularly this invention concerns a folding chair which can assume a plurality of different use positions.

BACKGROUND OF THE INVENTION

It is a well-known fact that virtually anyone after sitting in a chair for a while will need to change position in order to remain comfortable. Even a position that is comfortable to start with normally becomes uncomfortable with time so that the person must move for relief. This is typically done by leaning back or forward, solutions that often lead to inherently bad postures that in fact do more harm than good.

U.S. Pat. No. 4,793,655 of A. Kvalheim et al describes a multiposition chair adapted to support a person either in the standard manner with a main cushion under the person's posterior and a second cushion behind his back, or in a position with the second cushion pivoted around into a position below the main cushion and at an angle so as to rest against the shin area of the person, in which case the main cushion is angled forward and down. In addition it is possible for the second cushion to be tipped back and for the user to sit on it with his or her back resting against the forwardly and downwardly inclined main cushion. The switchover between positions here is fairly complex, involving completely reversing the chair and various other manipulations that are fairly difficult.

German patent document 2,558,639 of G. Kerstholt describes another chair where the seat cushion can pivot about a horizontal axis for forward and backward tipping. Springs urge this seat into a central level position. As a result in anything but the standard straight-up position, the user must exert force to maintain the seat tipped. This is fatiguing in the long run and, hence, not comfortable.

OBJECTS OF THE INVENTION

It is therefore an object of the present invention to provide an improved multiposition chair.

Another object is the provision of such an improved multiposition chair which overcomes the above-given disadvantages, that is which can easily be set in various different positions without having to be reversed, and that is comfortable in all of these positions.

A further object is to provide such a chair which is usable in positions not normally assumable by a chair, for instance as a lectern.

Yet another object is to provide a multiposition chair that can be knocked down flat for storage or transport.

SUMMARY OF THE INVENTION

A multiple-position chair according to the invention has a main frame, a lower frame, and an intermediate frame. The main frame has a pair of parallel longitudinal side bars having lower ends normally engaging the ground and upper ends and a transverse bar interconnecting the lower ends. The lower frame has a pair of parallel side bars having upper ends pivoted about a transverse lower axis on the main frame intermediate the main-frame ends and lower ends normally engaging the ground. The lower-frame side bars each are formed intermediate their ends with a row of upwardly open seats. A transverse bar interconnects the lower ends of the lower-frame side bars. The intermediate frame has a pair of parallel side bars having upper ends pivoted on the main-frame side bars about a transverse intermediate axis at the main-frame upper ends and lower ends and a transverse bar interconnecting the lower ends of the intermediate-frame side bars and fittable in the seats of the lower-frame side bars. All the transverse bars are generally parallel. A flat main support is generally centrally pivoted on the frames about the lower transverse axis at the upper ends of the lower frame and an intermediate flat support is generally centrally pivoted on the frames about the intermediate transverse axis at the upper ends of the main frame. A lower axle forms the lower axis of the intermediate flat support and the axis of the upper ends of the intermediate frame and an intermediate axle forms the intermediate axis of the lower flat support and the axis of the upper ends of the lower frame.

The chair according to this invention can therefore be set up for normal sitting with the lower flat support under the user's buttocks and the intermediate flat support behind his or her shoulders. Alternately the user can sit on the intermediate support with his or her shins against the lower support, which to this end tips somewhat back, for a kneeling posture very useful for someone working at a drafting table, for instance.

According to another feature of this invention the chair also has an upper frame having a pair of parallel side bars having lower ends pivoted on the upper ends of the main-frame side bars about a transverse axis and upper ends and a transverse bar interconnecting the upper ends of the upper-frame side bars and an upper support pivoted on the transverse bar of the upper frame. Means is provided for securing the upper frame on the main-frame upper ends at any of a plurality of angularly offset positions. This upper support has at least one side formed as a cushion and opposite this one side an opposite side formed as a hard surface.

In accordance with this invention the lower ends of the side bars of the upper frame are forked and fit over the intermediate axle so that the upper frame can be lifted off the intermediate axle and reversed. Furthermore the lower ends of the side bars of the upper frame can slide along the intermediate axle. To this end a stop unit is provided for arresting the lower ends of the side bars of the upper frame in any of a plurality of vertically offset positions along the intermediate axle. This stop unit includes respective stops carried on the main-frame side bars below the intermediate axle and each having a central pivot and a head with a plurality of sides differently spaced from the respective pivot and engageable with the lower ends of the upper-frame side bars. A respective nut can arrest each stop in any of a plurality of angularly offset positions on the respective main-frame side bar.

Furthermore according to the invention arm rests are secured to the main-frame side bars and a stop on the main frame inhibits pivoting of the intermediate support backward beyond a horizontal position.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 1 is a perspective view of a chair according to this invention;

FIGS. 2 and 3 are small-scale side views of the FIG. 1 chair in two different use positions;

SPECIFIC DESCRIPTION

Figure 6:
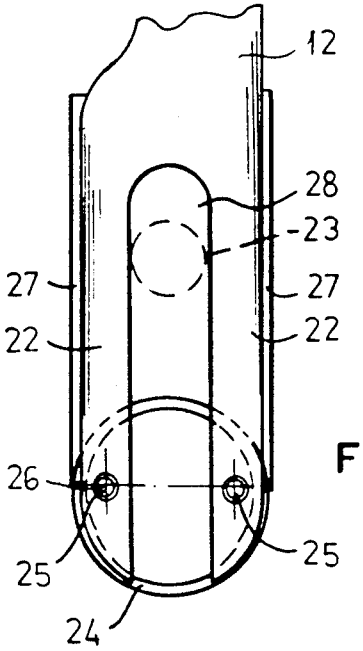
FIG. 6 is a side view of the detail indicated at VI in FIG. 4.
Figure 6A:
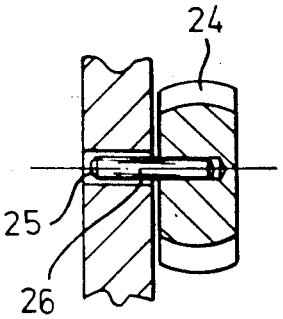
FIG. 6*a* is a sectional view of the detail of FIG. 6.

As seen in FIGS. 1 through 3 a chair according to this invention has a main frame formed of longitudinal bars 1, a lower transverse rod 1*a*, and an upper pivot rod 23 defining a pivot axis 7. A lower frame has a pair of bars 2 with rear edges formed with seat notches 8 and bridged by a lower transverse rod 2*a*. This lower frame 2, 2*a* is pivoted generally centrally on the main frame 1, 1*a* about an axis 4 which is parallel to the axis 7 and lower rod 1*a*. An upper frame basically comprises a pair of bars 5 having upper ends pivoted at 7 on the main frame 1, 1*a* and lower ends bridged by a transverse rod 5*a* that can sit in the seats 8. A main support 3 is formed as a flat rectangular cushion centrally pivoted on the frame 1, 1*a* at the axis 4 and an intermediate cushion 6 of similar construction is pivoted on the frame 1, 1*a* at the axis 7.

J-shaped arms 11 (not shown in FIGS. 2 and 3 for clarity of view) have upper ends secured to the bars 1 just below the axis 7 and lower ends secured in seats just above the lower axis 4. The rounded ends of the armrests 11 carry threaded sleeves that extend perpendicular to the respective bars 1 and that align with respective holes in these bars 1 to receive retaining bolts.

FIG. 2 shows how it is possible to seat the rod 5*a* in one of the upper seats 8 so a user 10 can sit in the inventive chair in normal fashion, that is with the posterior seated on the cushion 3, the back pressed back against the cushion 6, and the feet flat on the floor.

Alternately as seen in FIG. 3 the rod 5*a* can be seated in one of the lowermost seats 8, thereby bringing the cushion 6 down for a more kneeling posture whereby the user's shins are supported against the cushion 3 while the posterior is on the intermediate cushion 6 and the toes are at most engaging lightly on the floor. In this position the cushion 3 is tipped somewhat down and backward and the cushion 6 somewhat down and forward.

The system of FIGS. 4 through 18 uses the same base chair as in FIGS. 1 through 3, but is equipped with a fourth frame, here an upper frame formed by bars 12 bridged by an upper cross rod 15 defining an axis 9 parallel to the axes 4 and 7. An upper support cushion or rest 30 is pivoted about the axis 9 on the rod 15. This cushion 30 comprises as seen in FIG. 18 a cushioned front side 13, a rigid edge part 31, and a flat hard rear side 14 formed with a retaining ridge 38 so that this face 14 can be used as a book rest. In addition as seen in FIG. 15 in this arrangement the upper end of the bars 1 are bridged right behind the rod 23 on which the rest 6 is mounted by a stop rod 39 that prevents the rest 6 from pivoting back beyond a horizontal position.

Figure 4:
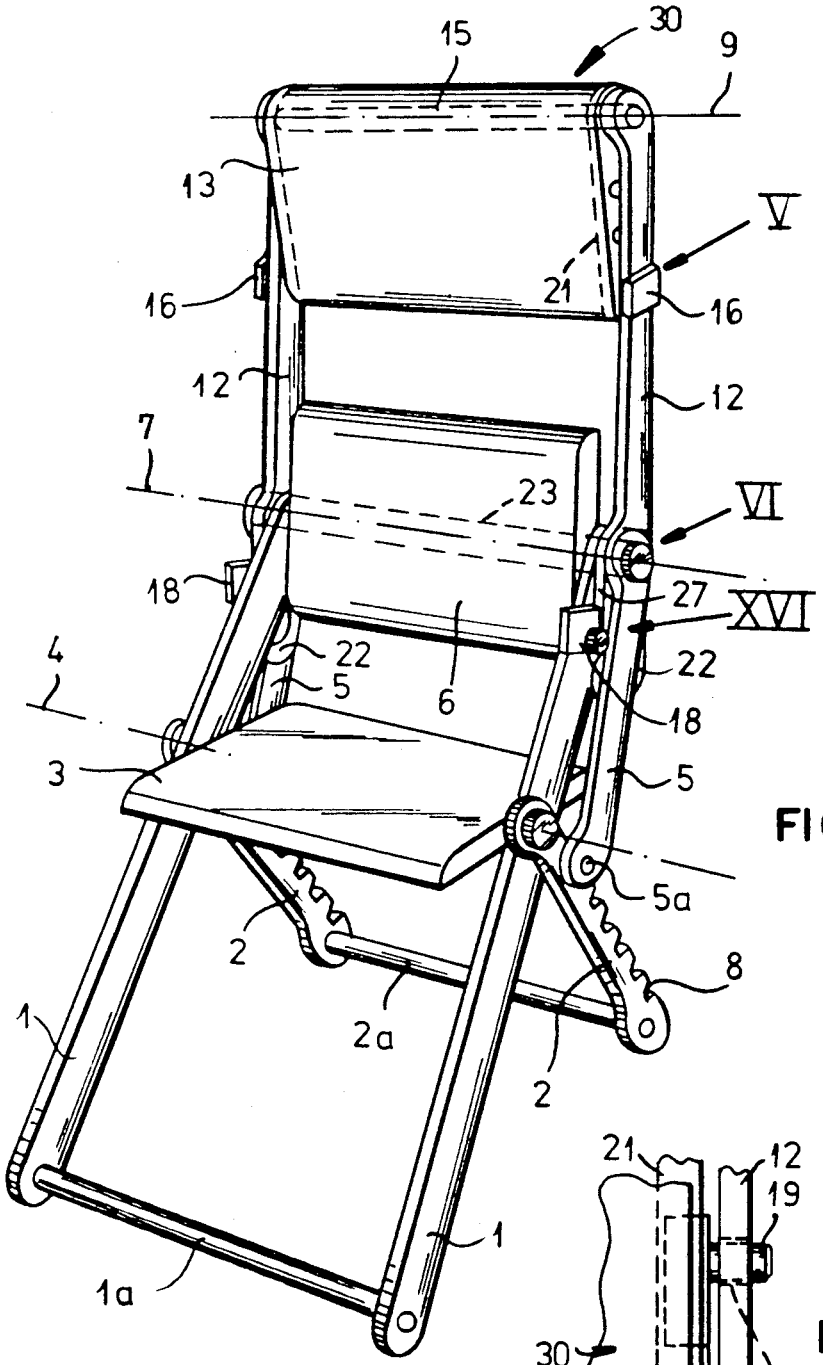
FIG. 4 is a perspective view of another chair in accordance with this invention.
Figure 5A:
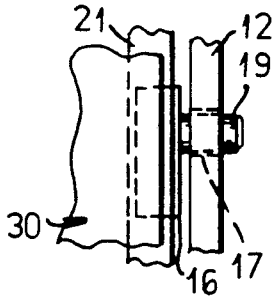
FIGS. 5*a* and 5*b* are front views of the FIG. 5 detail in two other positions.
Figure 5:
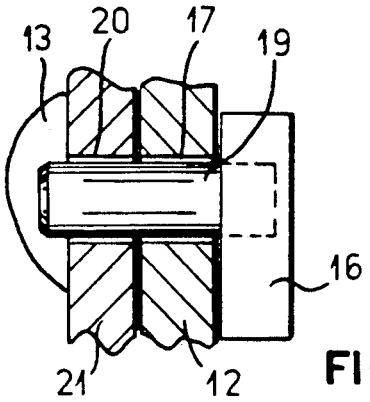
FIG. 5 a section through the detail indicated at V in FIG. 4.
Figure 5B:
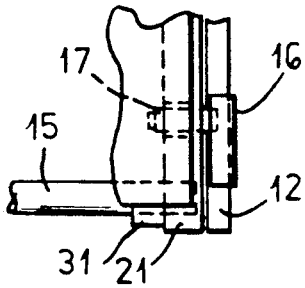

Each bar 12 is formed with two throughgoing holes 17 adapted to receive a pin 19 of a stop 16 shown in FIGS. 5, 5*a*, and 5*b*. The stop 16 itself is a square block of solid material and the pin 19 is eccentric to the sides of the block so that different angular positions of the stop 16 will differently position something bearing on the block side. In addition the upper cushion 30 has side elements 21 formed with holes 20 alignable with the lower holes 17 to allow the pins 19 of the stops 16 to engage through both of them and hold the cushion 30 in the positions of FIGS. 4, 7, 8, 9, 10, 11, 13, and 14. Alternately the stops 16 can be inserted from inside through the lower upper holes 17 so that the cushion 30 can be pivoted up to rest on it, lying outside the plane of the upper frame 12, 15 as shown in FIG. 12 and in dashed lines in FIG. 14, with the angular position of the support 30 determined by which side of the stop it rests against.

The lower ends of the bars 12, which are each received between the respective bar 5 on the outside and the respective bar 1 on the inside to be coplanar with the respective bar 2, are each as seen in FIG. 6 formed with a central slot 28 defined between two side parts 22 and engaged around the respective ends of the rod 23. At its lower end the side parts 22 are formed with holes 26 by means of which they are attached to a disk 24 by bolts 25 to close the slot 28. Thus the upper frame 12, 15 can slide on the axis 7 the length of the slot 28. In addition the sides of the side parts 22 are provided with a friction cladding 27 with a gritty nonslip surface.

Figure 16:
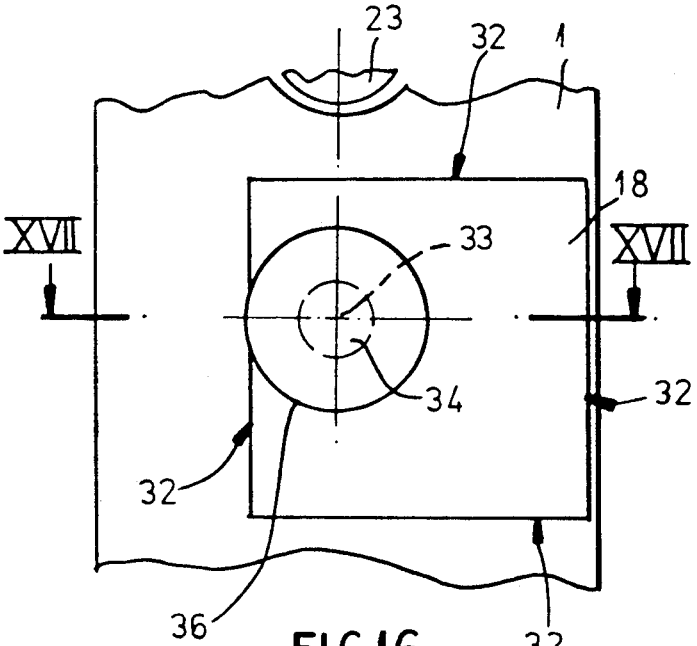
FIG. 16 is a side view of the detail indicated at XVI in FIG. 4.
Figure 17:
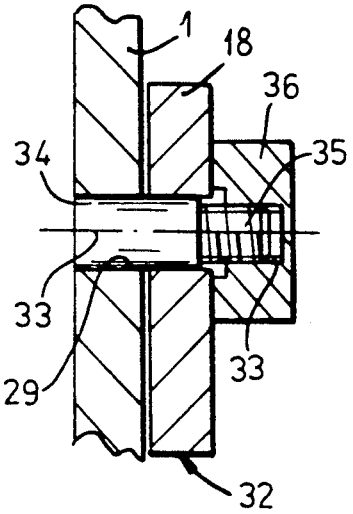
FIG. 17 is a section taken along line XVII of FIG. 16.
Figure 18:
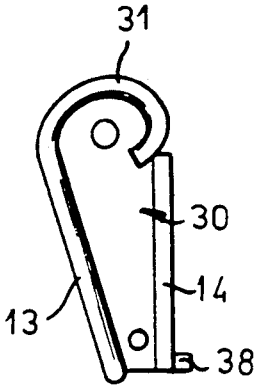
FIG. 18 is a small-scale side view of a detail of the chair of FIG. 4.

Just below the axis 7 each of the side bars 1 of the lower frame 1, 1*a* is formed as seen in FIGS. 16 and 17 with a hole 29 in which is fixed a respective pin 34 centered on an axis 33 parallel to the axes 4, 7, and 9 and having a threaded outer end 35 engaged in a threaded bore 37 of a nut 36. A polygonal stop plate 18 having four or six sides 32 is fitted between each nut 36 and the respective side bar 1, with the central hole of the plate 18 eccentric to its sides 32.

It is therefore possible for the chair of FIGS. 4 through 18 to assume seven significantly different positions, and even for it to have some range of shape change in several of the positions.

Figure 7:
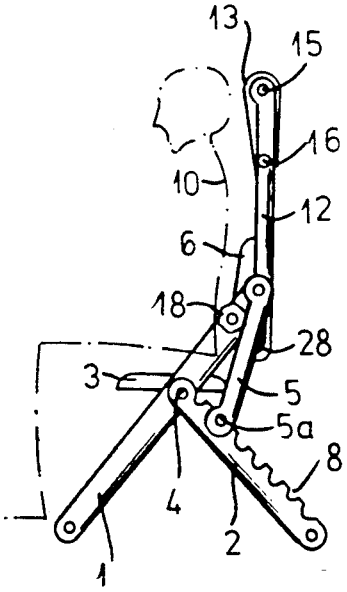
FIGS. 7, 8, 9, 10, 11, 12, 13, and 14 are small-scale side views of the FIG. 4 chair in different use positions.

FIG. 7 shows the chair in the position of FIG. 4. Here the stops 16 maintain the upper cushion 13 as a head rest and the stops 18 maintain the frame 12, 15 vertical.

Figure 8:
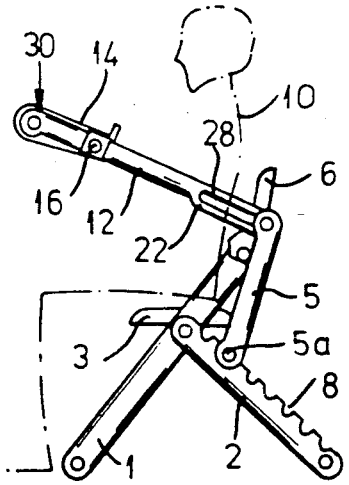

In FIG. 8 the upper frame 12, 15 has been pivoted forward so the forward friction layers 27 lie on the stops 16 with the frame 12, 15 pulled up so that the rod 23 is at the lower ends of the slots 28. In this position the rear surface 14 can be used as a book rack.

Figure 9:
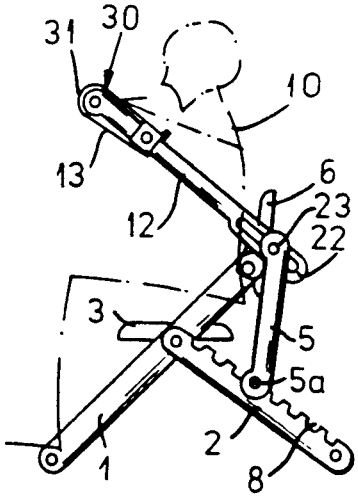

Slight rotation of the stops 16 allows the frame 12, 15 to be pivoted up a little from the position of FIG. 8, and it can be slid down a little on the rod 23 to assume the position of FIG. 9 in which the element 30 serves as a forearm rest. In this position also the intermediate frame 5, 5*a* is moved down to the middle of the stops 8, thereby lowering the seat cushion 3.

Figure 10:
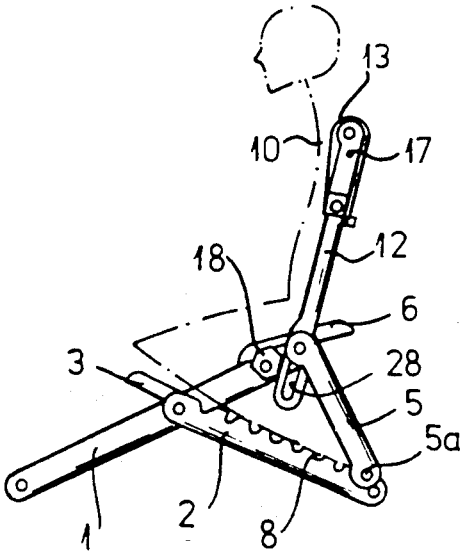

FIG. 10 shows the frame 5, 5*a* set in the lowermost position and the upper frame 12, 15 assuming the same position relative to the fame 1, 1*a* as in FIG. 7, so that the user 10 can sit on the cushion 6 while resting his or her shins against the cushion 3 and his or her back against the rest 30.

Figure 11:
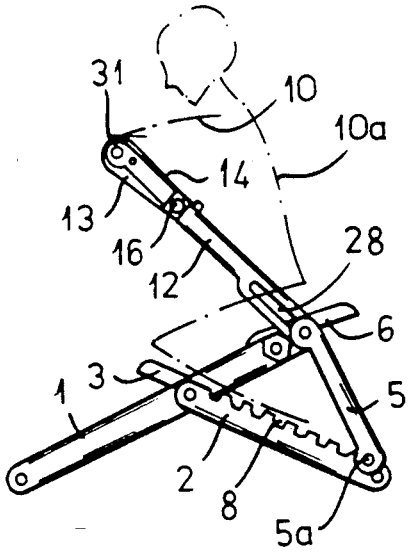
Figure 12:
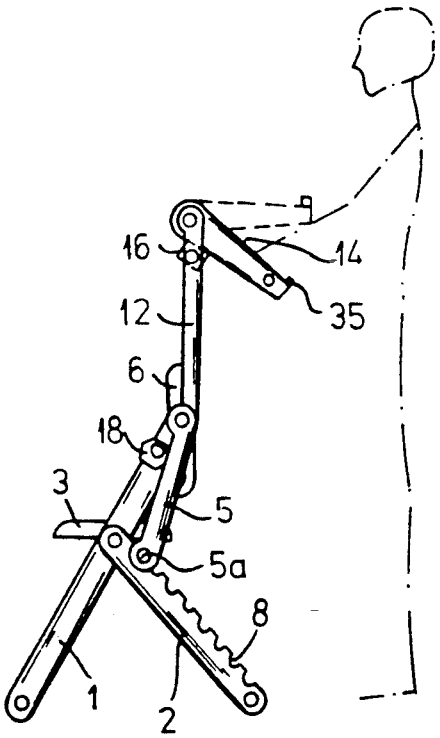

In FIG. 11 the upper frame 12 is pivoted forward as in FIG. 8 for use of the rest 30 to support the forearms of the user 10.

In FIG. 12 the frames all are in the same positions as in FIG. 7, but the rest 30 is pivoted up and held in place by the stops 16 inside the bars 12 for use as a lectern. The rest 30 can either be angled as shown in solid lines or horizontal as shown in dashed lines.

Figure 13:
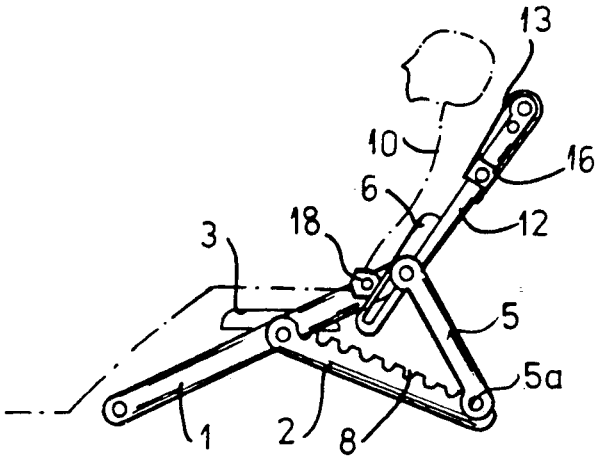

The position of FIG. 13 allows the user 10 to recline. Here the intermediate frame 5, 5*a* is set in the lowermost stops 8 and the upper frame 12, 15 is tipped back and supported at the upper ends of the slots 28 on the rod 23 and against the stops 18 in this position. The headrest 30 is maintained coplanar with the frame 12, 15. The user 10 sits on the lower rest 3 with his back against middle rest 6 and neck region against the upper rest 30.

Figure 14:
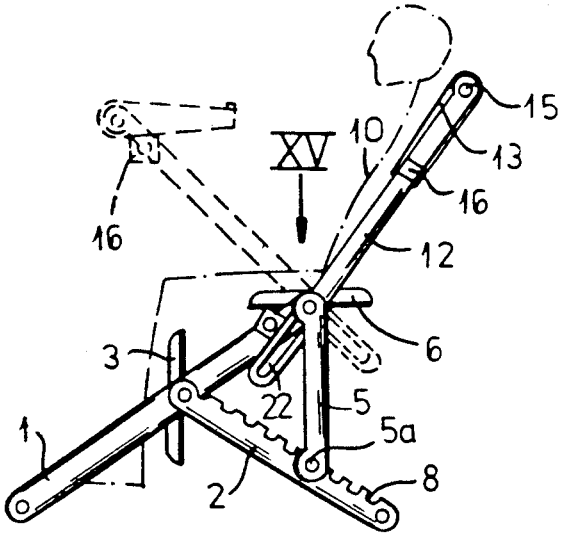
Figure 15:
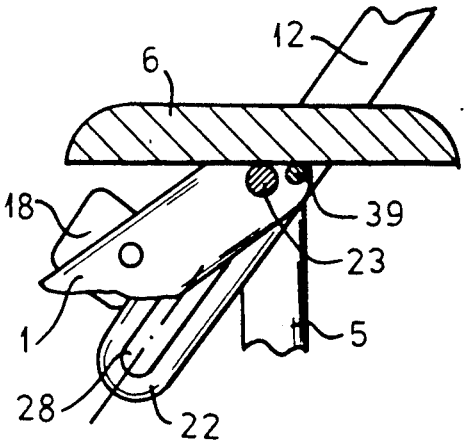
FIG. 15 is a vertical section through the detail indicated at XV in FIG. 14.

In FIG. 14 the lower rest 3 is vertical to sit behind the user's calves and the upper frame 12, 15 is tipped slightly back as in FIG. 13. It is possible to pivot this frame forward as indicated in dashed lines and to hold the rest 30 up as illustrated for use as a keyboard or reading rack.

I claim:

1. A multiple-position chair comprising:

a main frame having a pair of parallel longitudinal side bars having lower ends normally engaging the ground and upper ends, and a main transverse bar interconnecting the lower ends;

a lower frame having a pair of parallel side bars having upper ends pivoted about a lower transverse axis on the main frame intermediate the main-frame ends and lower ends normally engaging the ground, the lower-frame side bars each being formed intermediate their ends with a row of upwardly open seats, and a lower transverse bar interconnecting the lower ends of the lower-frame side bars;

an intermediate frame having a pair of parallel side bars having upper ends pivoted on the main-frame side bars about an intermediate transverse axis at the main-frame upper ends, and a intermediate transverse bar interconnecting the lower ends of the intermediate-frame side bars and fittable in the seats of the lower-frame side bars, all the transverse bars being generally parallel;

a flat main support generally centrally pivoted on the frames about the lower transverse axis; and an intermediate flat support generally centrally pivoted on the frames about the intermediate transverse axis, whereby the relative angle of the main support and intermediate support can be varied by positioning the intermediate transverse bar in different seats.

2. The multiposition chair defined in claim 1, further comprising a lower axle connected to the lower-frame upper ends, to the main-frame side bars, and to the main support and forming the lower axis; and an intermediate axle connected to the main-frame and intermediate-frame upper ends and to the intermediate support and forming the intermediate axis.

3. The multiposition chair defined in claim 2, further comprising an upper frame having a pair of parallel side bars having lower ends pivoted on the upper ends of the main-frame side bars about the intermediate transverse axis and further having upper ends, and a upper transverse bar interconnecting the upper ends of the upper-frame side bars; and an upper support pivoted on the upper transverse bar about an upper axis; and means engageable between the upper-frame side bars and the main-frame side bars for securing the upper frame on the main-frame upper ends at any of a plurality of angularly offset positions, whereby the relative angle of the upper frame and main frame can be varied.

4. The multiposition chair defined in claim 3 wherein the upper support has at least one side formed as a cushion.

5. The multiposition chair defined in claim 4 wherein the upper support has opposite its one side an opposite side formed as a hard surface.

6. The multiposition chair defined in claim 3 wherein the lower ends of the side bars of the upper frame are forked and fit over the intermediate axle, whereby the upper frame can be lifted off the intermediate axle and reversed.

7. The multiposition chair defined in claim 3 wherein the lower ends of the side bars of the upper frame can slide along the intermediate axle.

8. The multiposition chair defined in claim 7, further comprising stop means engageable between the upper-frame side bars and the main-frame side bars for arresting the lower ends of the side bars of the upper frame in any of a plurality of vertically offset positions along the intermediate axle.

9. The multiposition chair defined in claim 8 wherein the stop means includes respective stops carried on the main-frame side bars below the intermediate axle and each having a central pivot and a head with a plurality of sides differently spaced from the respective pivot and engageable with the lower ends of the upper-frame side bars.

10. The multiposition chair defined in claim 9 wherein the stop means further includes means including a respective nut for arresting each stop in any of a plurality of angularly offset positions on the respective main-frame side bar.

11. The multiposition chair defined in claim 1, further comprising ar rests secured to the main-frame side bars.

12. The multiposition chair defined in claim 1 further comprising a stop on the main frame inhibiting pivoting of the intermediate support backward beyond a horizontal position.

* * * * *